US008424266B2

(12) United States Patent
Edmondson

(10) Patent No.: US 8,424,266 B2
(45) **Date of Patent: *Apr. 23, 2013**

(54) SLOTTED METAL STUD WITH A PLURALITY OF SLOTS HAVING SUPPLEMENTAL FLANGES AND FOLD BACK SUPPLEMENTAL WEB SUPPORT AT THE ROOT OF THE PRIMARY FLANGES

(76) Inventor: Dennis Edmondson, Marysville, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/107,888

(22) Filed: May 14, 2011

(65) Prior Publication Data

US 2012/0117917 A1 May 17, 2012

Related U.S. Application Data

(63) Continuation-in-part of application No. 12/685,261, filed on Jan. 11, 2010, now abandoned, which is a continuation-in-part of application No. 10/937,644, filed on Sep. 9, 2004, now Pat. No. 7,743,578.

(51) Int. Cl.
*E04H 12/00* (2006.01)

(52) U.S. Cl.
USPC ..... 52/653.1; 52/650.1; 52/840; 52/855

(58) Field of Classification Search ..... 52/840, 52/842, 846, 850, 851, 852, 855, 653.1, 673, 52/674, 675
See application file for complete search history.

(56) References Cited

U.S. PATENT DOCUMENTS

| | | | | | |
|---|---|---|---|---|---|
| 404,227 | A * | 5/1889 | Sagendorph | 52/674 |
| 420,654 | A * | 2/1890 | Hayes | 52/675 |
| 1,457,303 | A * | 6/1923 | Higgins | 52/842 |
| 2,065,378 | A * | 12/1936 | Kling | 52/842 |
| 2,966,708 | A * | 1/1961 | Freeman, Jr. | 52/696 |
| 3,839,839 | A * | 10/1974 | Tillisch et al. | 52/846 |
| 3,908,328 | A * | 9/1975 | Nelsson | 52/769 |
| 4,364,212 | A * | 12/1982 | Pearson et al. | 52/281 |
| 4,490,958 | A * | 1/1985 | Lowe | 52/634 |
| 4,672,785 | A * | 6/1987 | Salvo | 52/241 |
| 5,274,973 | A * | 1/1994 | Liang | 52/243 |
| 7,062,887 | B1 * | 6/2006 | Holdren | 52/653.1 |
| 7,743,578 | B2 * | 6/2010 | Edmondson | 52/653.1 |
| 7,866,112 | B2 * | 1/2011 | Edmondson | 52/650.1 |
| 2006/0191236 | A1 * | 8/2006 | Surowiecki | 52/733.3 |

* cited by examiner

*Primary Examiner* — Jessica Laux
(74) *Attorney, Agent, or Firm* — Joseph Z Ellsworth

(57) ABSTRACT

A metal building stud having two supplemental flanges extending from at least one slot in the stud web yielding a stud with increased strength, both in compression (longitudinally) and in shear (transverse). The slotted stud also includes a plurality of indents that also enhance the stud strength both in compression and in shear. The slotted web further presents a reduced web area through which heat or sound may be conducted and slots in which insulation is received, both increasing resistance to heat and sound transfer. Slots and supplemental flanges may also be provided in the stud primary flanges. The primary flanges may include a fold back portion under a line of flexure presenting two layers through which an attaching screw must pass under that line of flexure that retains the screw in the primary flanges.

7 Claims, 9 Drawing Sheets

SLOTTED METAL STUD WITH A PLURALITY OF SLOTS HAVING SUPPLEMENTAL FLANGES AND FOLD BACK SUPPLEMENTAL WEB SUPPORT AT THE ROOT OF THE PRIMARY FLANGES

This application is a continuation in part of that certain continuation in part application filed Jan. 11, 2010 under application Ser. No. 12/685,261 now abandoned of a previous application filed Sep. 9, 2004 under application Ser. No. 10/937,644 now U.S. Pat. No. 7,743,578 and claims the benefit thereof.

BACKGROUND

1. Field of the Invention

This invention relates to steel studs, trusses and joists comprising parallel flanges extending orthogonally from web sides, and more particularly to a stud, truss or joist with at least one slot in the web and including supplemental flanges extending from slot sides within the web. The steel studs, trusses and joists also comprise primary flange material folded back into the channel and running parallel along the primary flange. This material also extends along the root of the ninety degree radius connecting the primary flanges and the web sides.

2. Prior Art

Interior wall construction using horizontal channel beams as headers and footers and matching vertical studs received into the channel beams is well-known. Commonly, the studs are also channel-shaped and both are made of metal, typically cold formed metal and, typically steel. Similarly, metal buildings employ girts (sidewall bracing) and perlins (roof bracing). Roof rafters, headers, footers, beams and joists can also employ channel shaped members. (For purposes herein, use of the term "stud," "metal stud," "steel stud" and "building stud" are not meant to be restrictive or limitations but are meant generically to be synonymous and to include all materials from which such studs may be formed.)

Of all modes of failure, buckling (Euler or local) is probably the most common and most catastrophic. That is, a structure may fail to support a load when a member in compression buckles, that is, moves laterally and shortens in length. A steel stud may be described for these purposes as a slender column where its length is much greater than its cross-section. Euler's equations show that there is a critical load for buckling of a slender column. With a large load exceeding the critical load, the least disturbance causes the column to bend sideways, as shown in the inserted diagram, which increases its bending moment. Because the bending moment increases with distance from a vertical axis, the slight bend quickly increases to an indefinitely large transverse displacement within the column; that is, it would buckle. This means that any buckling encourages further buckling and such failure becomes catastrophic.

The traditional steel stud construction comprises a pair of parallel flanges extending orthogonally from a web. Commonly the flange distal end bends inward slightly to increase the compressive stability converting the flat two-dimensional flange into a three dimensional structure. For these purposes, "compressive stability, strength or stress" means a reference value that measures the load a structure can sustain before it buckles or otherwise deforms and loses support for a load.

Such studs are very poor energy conservers. For example, for internal walls the metal stud acts as a thermal conduit and actually enhances thermal conductivity across the wall over wood and other materials. In metal buildings the studs (girts and perlins) are in direct metal-to-metal contact with the outside material sheeting and become conduits of heat on the outside sheeting to inside the building. Heat passes through the web, so one interested in reducing thermal conductivity might consider removing material from the web to create slots in the web. To the extent such slots remove metal and thus reduce the thermal path, the stud is less conductive thermally. Also, such slots may receive insulation that further impede conductivity.

Similarly, a steel stud is a good acoustic conductor, which is detrimental in many applications. It has long been desired to reduce sound transmission through metal wall studs. As in thermal conductivity, re-shaping of a significant portion of the web or the flanges will reduce the acoustic conductivity of the stud and therefore the wall.

It is a primary object of the present invention to enhance the compressive stability, strength and bending resistance of a traditional steel stud. It is another object to reduce thermal conductivity and acoustical transmission, of the stud while enhancing the bending resistance and compressive stability and strength. To this end, it is a further object to introduce one or more slots in the stud web that interrupt conductivity across the web in combination with projections from the web at the slots additional to the primary flanges that enhance the load that a stud can support under bending and compression. It is a further object to provide indentations in the stud to enhance the strength of the stud and overcome weaknesses that are introduced at slot corners between slot ends and slot vertical sides.

SUMMARY

These objects are achieved in a first embodiment in a building stud having at least two supplemental flanges of a substantial areal dimension extending from a side of a corresponding slot in the web.

These supplemental flanges are formed by stamping out a flange in the web on three flange sides and then bending the supplemental flange away from the web on the fourth, uncut side, forming a slot in the web. The result then is a supplemental flange extending from the web at the slot edges. The supplemental flange usually extends normal to the web and parallel to the primary flanges that extend from the web edges, although it can be angled from the web other than normal. The slot in the stud web presents a reduced web area through which heat or sound may be conducted.

The flange is formed as the slot is formed by cutting the web for the slot, dividing the intended slot area of the web into two equal side by side panels and two equal panels at slot ends in the center and top and then folding the panels out from the plane of the web simultaneously forming the slot and a continuous supplemental flange at each slot side and end. Typically, the slot area is cut (stamped) with a U cut at the slot top and an inverted U at the slot bottom joined by a center cut between them. The top and bottom U panels are then folded outward to form horizontal supplemental flanges at the slot top and bottom and the side panels are folded out to form vertical supplemental flanges. For these purposes, the described "U" shape is deemed to represent all shape variations of horizontal flanges formed at slot ends.

Rather than weaken the stud at the slot, the stud is in fact strengthened through a few mechanisms. First, the longitudinal extent of the web of a traditional stud presents a large vertical plane susceptible to local shear buckling under load that can lead to Euler bucking. Introducing slots having supplemental flanges into the web reduces that extent. That is, the Supplemental Flange Metal Stud ("SFMS") itself actually stiffens the web plane by creating smaller flat planes in the web plane than are present in standard steel studs thus increasing local shear buckling resistance.

The calculation discloses that for vertical loading the SFMS provides better stability in buckling resistance due to the center of gravity being moved away from the plane of the web toward the opening of the channel section. This effect distributes the vertical load more uniformly over the SFMS cross-sectional area; rather than mostly in the web as standard steel studs do; and thus forcing local buckling effects to require a higher vertical loading than standard steel studs can handle. The SFMS also enhances resistance to Euler buckling (long column lateral deflection) by the new properties the supplemental flanges provide. In short, for the stud to bend at the slot, both the supplemental and primary flanges orthogonal to the web must also bend, but with the supplemental flanges, there is increased resistance to that bending.

The supplemental flange can be either continuous (fully encompassing the slot) or discontinuous (not completely encompassing the slot) although the former will provide for greater strength and structural stability than the latter. When all the original material in a traditional metal stud remains in the final SFMS product, in the case of supplemental flanges extending from the full length of slot sides the SFMS retains more than the total cross-sectional area of the traditional stud, which retains its support for compressive loads and provides additional rigidity that equates to better stud stability than traditional steel studs. This is demonstrated in both the x-axis and y-axis bending calculations below.

Calculations confirm that adding the supplemental flange to the flange at the slot sides and ends not only fully offsets any loss of compressive strength caused by the slot but actually increases it over the unmodified stud without slots or supplemental flanges. That is, the stud can sustain a greater compressive, or longitudinal, or bending load with slots and supplemental flanges than without them. The following calculation is typical:

The following calculation assumes a 16 gauge "C"-Section Channel, 6"×2½" (0.0598" wall thickness) stud.

The strength of a load-supporting column can be represented by the moment of inertia about the major axis, X-X, where buckling could occur first. When the moment reaches a high enough value, known as the Euler Buckling under load the column will buckle. This value is proportional to the moment of inertia, so the higher the moment of inertia, the more load the column will sustain before buckling.

The following equation calculates the moment of inertia ($in^4$) about the X-X axis for a channel cross-sectional area. The designated sections are as represented in FIG. 27.

$$I_{x-x} = 2(A_1 d_1^2) + 2(A_2 d_2^2) + 2\left(\frac{bh^3}{12}\right) + 2(A_3 d_3^2) + 2(A_4 d_4^2)$$

where h=0.0598 inch, the thickness of 16-gauge cold formed steel.

b=width of various sections. For the calculation of $I_{x-x}$, it will be determined from a central axis between the two widths, 2.50 inches, 1.00 inch, and perpendicular to the 0.375 inch dimension. For the calculation of $I_{y-y}$, it will be determined by an axis transverse to the two width dimensions, 2.50 inches, 1.00 inch, and parallel to 0.375 inch dimension.

d=distance (in) from the neutral axis to each centroid of an area "A", respectively.

The neutral axis is located at the centroid or center of gravity, CG, of the stud. It is determined using the equation, $$CG_{y-y}{}^{i} = yA_i/A_t$$

where $A_i$ represents the cross-sectional area of each area that makes up the total cross-sectional area, $A_t$.

TABLE 1

| Component | A, area ($in^2$) | | y (in) | yA ($in^3$) |
|---|---|---|---|---|
| A-1 | 0.0598)(2.5( )2 = | 0.2990 | 1.25 | 0.374 |
| A-2 | (0.0598)(1)2 = | 0.1196 | 0.5 | 0.0598 |
| A-3 | (0.0598)(2)(2) = | 0.2392 | 0.0299 | 0.0072 |
| A-4 | (0.0598)(0.375)2 = | 0.0449 | 2.5 | 0.1123 |
| Totals | $A_t$ = | 0.7027 | $yA_i$ = | 0.5533 |

Using the values in the Table 1 to compute CG, $CG_{y-y}$=yA/A=(0.5533)/(0.7027)=0.7868 inch from the inside face of web. With this information the values for $I_{x-x}$ and $I_{y-y}$ of the supplemental flange stud can be calculated.

$$\begin{aligned} I_{x-x} &= 2(A_1 d_1^2) + 2(A_2 d_2^2) + 2\left(\frac{bh^3}{12}\right) + 2(A_3 d_3^2) + 2(A_4 d_4^2) \\ &= 2(0.0598)(2.5)(2.9701)^2 + 2(0.0598)(1.0)(1.0)^2 + \\ &\quad 2\left(\frac{(0.0598)(2.0)^3}{12}\right) + 2(0.1196)(2)^2 + 2(0.0224)(2.8125)^2 \\ &= 4.15\text{-inch}^4. \end{aligned}$$

To determine the percentage increase in load that the stud with supplemental flanges can sustain, we next compute the moment of inertia about the major X-X axis of a standard steel stud (without the advantage of the supplemental flanges). Substituting the values as before, $$\begin{aligned} I_{x-x} &= \left(\frac{bh^3}{12}\right)_{SS} + 2Ad_{SS}^2 + 2\left(\frac{bh^3}{12}\right)_{SS} + 2Ad_{SS}^2 \\ &= \left(\frac{0.0598(6.0)^3}{12}\right) + 2(0.0598)(2.5)(3.0)^2 + \\ &\quad 2\left(\frac{0.0598(0.375)^3}{12}\right) + 2(0.0598)(0.375)(2.8125)^2 \\ &= 3.23\text{-inch}^4. \end{aligned}$$

The percentage improvement in the stud with supplemental flanges is [(4.15-3.23)/(4.15)](100), or 22.3% stronger than an equivalent Standard Steel Stud.

It has also been determined that resistance to local shear deflection of the stud is also enhanced for the slotted stud with supplemental flanges extending from the web at slot sides. That is, the stud with supplemental flanges also supports a greater lateral load, or a load placed intermediate a nonvertical stud directly on the web, on a slotted metal stud with supplemental flanges than on a metal stud without these features.

Though the stud is structurally enhanced by the supplemental flanges as discussed above, perhaps the most advantageous contribution of the supplemental flanges is that the web can be slotted without diminishing the structural integrity of the stud, and in fact providing an enhanced structure. The slots interrupt heat (and acoustical) flow through the web across the wall employing the stud. Prior to the described slotted stud with supplemental flanges, metal studs were disfavored because they are a poor insulator; in fact, they are a good conductor, defeating efforts for energy conservation and noise containment. Wood remained the preferred stud material because of the low conductivity of wood. The "R" factor for wood (fir, pine, and spruce) for a 2"×6" stud is 361 K/w. [1 W/mK=0.578 BTU/Hr-ft-° F.]. The "R" factor for a steel same-sized slotted stud is 846 K/W. The rate of heat loss through the wood stud is 0.055 W and through the slotted steel stud is 0.024 K/W, or less than half. The steel stud immediately becomes competitive and even advantageous. In addition, instead of air in the slot, which conveys heat by convection, insulation can be added. Typically, a wall of slotted studs as described is insulated with insulation foam filled between the studs. The foam is liquid when blown into the wall studded and flows through the slots into several areas between the studs. When the foam dries, the foam not only fills the area between and within the studs but the foam also remains through the stud slots, preventing air flow and consequent thermal transfer by convection as well as by conduction. The slotted stud enhanced structurally by the supplemental flanges and thermally by the slots and insulation in the slots thus becomes an attractive wall construction alternative.

It is clear that the open slot left in the SFMS that is created by the supplemental flange manufacturing process can vary in width and length depending on the requirements needed from the SFMS. Changes in this width and length will affect the various geometric properties It is recognized that drilling, shearing or punching of a metal sheet commonly causes a burr to protrude slightly from an edge of a hole or side that has been drilled, sheared or punched. This natural consequence of cutting metal is ignored for purposes herein and not included in use of the term "flange."Rather, use of the term "flange" for purposes herein is meant to define a broad structure projecting substantially from the metal sheet, generally planar typically, a distance significantly greater than a burr, which flange has been formed deliberately of substantial material, comparatively much greater than a burr resulting from cutting, for a structural purpose such as to give additional strength. As provided herein, another structural purpose of the flange is to substantially or significantly move the center of gravity of the stud away from the metal sheet (e.g., web) from which the flange extends, which is not accomplished by a burr. As shown in the figures, the flanges as the term is used herein typically comprise at least a major portion of the material removed to form the slot.

Horizontal supplemental flanges bending into the stud channel at slot ends also enhance stability of a slotted stud by resisting horizontal bending of the stud at the slot. This is expressed in an increased section modulus, which is the resistance factor in a structural component that resists bending by increasing the Euler Buckling limit, F, where, $$F = \frac{\pi^2 EI}{(KL)^2}$$

where

F=maximum or critical force (vertical load on column)

E=modulus of elasticity,

I=area moment of inertia

L=unsupported length of column

K=column effective length factor, whose value depends on the conditions of end support of the column. For both ends pinned, (hinged, free to rotate), K=1.0. For one end fixed and the other end pinned, k=0.699. For one end fixed and the other end free to move laterally, K=2.

Thus, slot end flanges provide both an increased section modulus for the bridge between slot ends, it also provides material for resistance of longitudinal shear flow, tau−VQ/It, where Q is the first moment of the bridge cross-sectional area of interest (width times thickness), "V" is the transverse load, "I" is the moment of inertia of section of interest, and "t" is the metal thickness. For a small width to length ratio such as in the bridge, tau=3v/2A, where A is the cross-sectional area of section of interest.

There is an inherent weakness at a corner of the slot at ends of the vertical slot sides from which a supplemental flange bends. That is where the slotted stud is subjected to a maximum load it is at this location that the stud is likely to fail first. It is therefore advantageous to strengthen the stud at these locations. It has been determined that an indentation in a generally flat surface that bridges a point of weakness strengthens the weak point and even substantially if not entirely overcomes the weakness. The indentation is sufficient if its depth is even only approximately the thickness of the material, in this case the stud thickness. The indentation provides a rib in the surface that resists bending along the length of the rib. It is therefore advantageous to provide an indentation near the corner of the slot ends.

Indentation strengthening and stability increase is related to a b/t ratio, where "b" is the metal sheet width of interest and "t" is the thickness of the material. $Rho=K_c E (t/b)^2$ expresses a stress condition for metal sheet buckling in its general form, where $K_c$ is a constant dependent on edge constraints; E is the modulus of elasticity of the material, "t" is the thickness of a metal sheet; and "b" is the width of the metal sheet of interest. Edge constraints prevent Euler buckling (which does not have edge constraints) but do not prevent local buckling. Thus the ratio of the width of an indent to the thickness of the material governs the resistance to local buckling when a metal sheet panel is subjected to either compressive loading, bending loading or both simultaneously. Therefore providing a narrow or relatively small area of indentation causes the original geometry of the metal sheet to become more rigid and thus more stable than a flat surface. Indents also provide additional strength through the effect of cold working the metal sheet. The slotted stud of the present invention requires substantial web material between ends of adjacent slots, termed the bridge herein, to maintain stability and strength of the stud with the improved strength of material provided by the indentations, the bridge between adjacent slot ends can be reduced. That is, the vertically adjacent slots spaced apart by the bridge between them can be closer together the bridge can be thinner. As previously discussed, it is through these bridges in the stud that heat and sound are transmitted between rooms separated by the studs and wall board attached to the primary flanges of the studs. With the thinner bridges, the path through which sound and heat is transmitted is reduced, which make the stud a more attractive alternative both for internal and external building walls.

The slots can be of a variety of shapes and still achieve the desired effectiveness. Some alternate shapes are described in this presentation. It should be understood that in providing examples of alternate shapes, the shapes described are not limiting but are presented as representative of all other shapes, all of which are deemed included through the representative descriptions presented.

A vertical indentation alongside but spaced apart from the slots that extends past a bridge between a location in the web that is adjacent to a position intermediate a first slot to a location in the web that is adjacent to a position and intermediate a next adjacent slot will serve to strengthen a weakness at that bridge. However, the advantage of indentations in an otherwise broad surface is not limited to overcoming weakness in a cut corner as with the slots and supplementary flanges. A vertical indentation in the web that extends the length of the stud, and then equivalently the length of the web of the stud, strengthens the stud, even a stud without a slotted web. Such a full length indentation can be implemented alongside an indentation at the bridge or can be implemented as part of the indentation at the bridge. It can also be implemented in the primary flanges without regard to or in addition to indentations in the slotted web, further strengthening the stud against a bending or a compressive load.

A slotted stud as described that is required to support a given compressive load can be constructed of lighter gauge material, typically steel. It has been found that thin walled steel studs are problematic when one attempts to secure wallboard to the primary flanges of the stud. Screws used do not bind into the flanges well. When using such a slotted stud it has become desirable to employ an additional mechanism to secure the screws. This has been achieved in providing a fold back member that bends at the distal end of the primary flange, which the primary flange proximal end is at the web, back into the channel between the primary flanges and along but spaced apart from a primary flange leaving a gap between the primary flange and the fold back member. Thus, a line of flexure is provided at the bend between the primary flange and the fold back member. When a screw is screwed through the primary flange, the screw then pushes slightly against the fold back member flexing the fold back member at the line of flexure. The screw then threads into the fold back member also with the fold back member in a condition of flexure, which acts to squeeze against screw threads, either in tensioning or compressing the screw shank. This works to secure the screw in the primary flange, even using thin-walled steel for the stud.

It should be understood that it is common to fabricate a steel stud with a flange lip; that is, with a flange portion extending inward from the primary flange at its distal end, in which case the fold back member begins at the distal end of the flange lip and proceeds spaced apart from and along the flange lip and then along the primary flange creating a line of flexure both at the distal end of the flange lip and at the distal end of the primary flange. This variation and all other similar variations of construction of the primary flange are deemed included for all purposes herein in the references to the primary flange in regard to the fold back member.

A steel stud is often attached vertically to a horizontal channel member with the stud received into the channel. The stud can be secured in place by an "L" bracket with a horizontal leg attached to the channel member, typically with screws, and a vertical leg attached to the web of the stud. When slots in the stud web extend to near the end of the stud, the upper leg of a normal "L" bracket might at least partially cover the slot nearest the end of the stud. Therefore, an "L" bracket is provided with the vertical leg notched with a channel matching the slot such that the slot is not covered by the bracket.

The fold back member further extends along the ninety degree radius connecting the web portion to the primary flange nesting in the radius and extending to the web. This ninety degree extension provides additional stiffness at the bend and resists the inward flexure of the primary flanges during buckling.

DETAILED DESCRIPTION OF THE PREFERRED EMBODIMENTS

Figure 1:
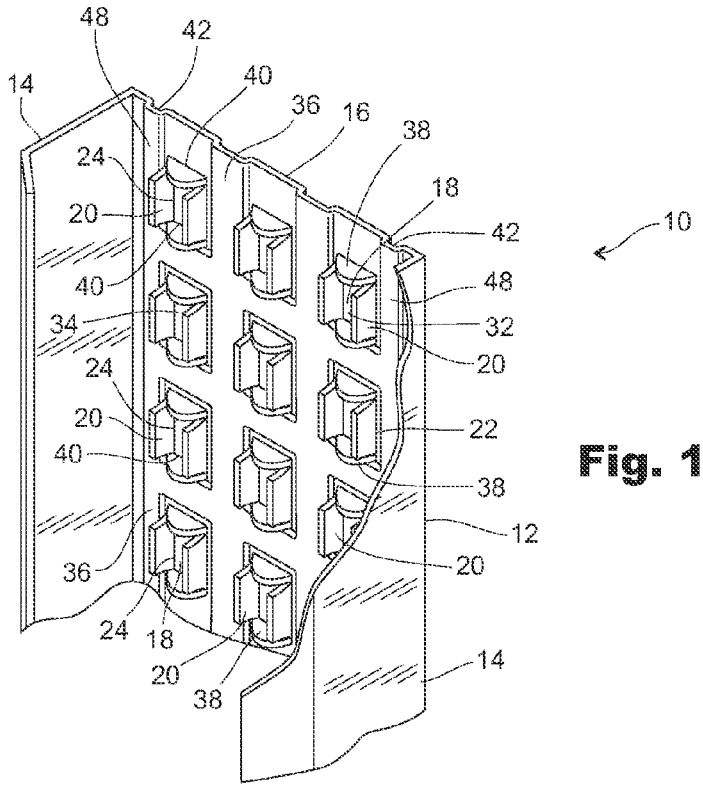
FIG. 1 is a perspective front view of the slotted stud with a plurality of side by side slots of a first set of slots alternating longitudinally with a plurality of side by slots of a second set of slots aligned with slots of the first set of slots, showing indentations of a ladder shape about the slots.
Figure 2:
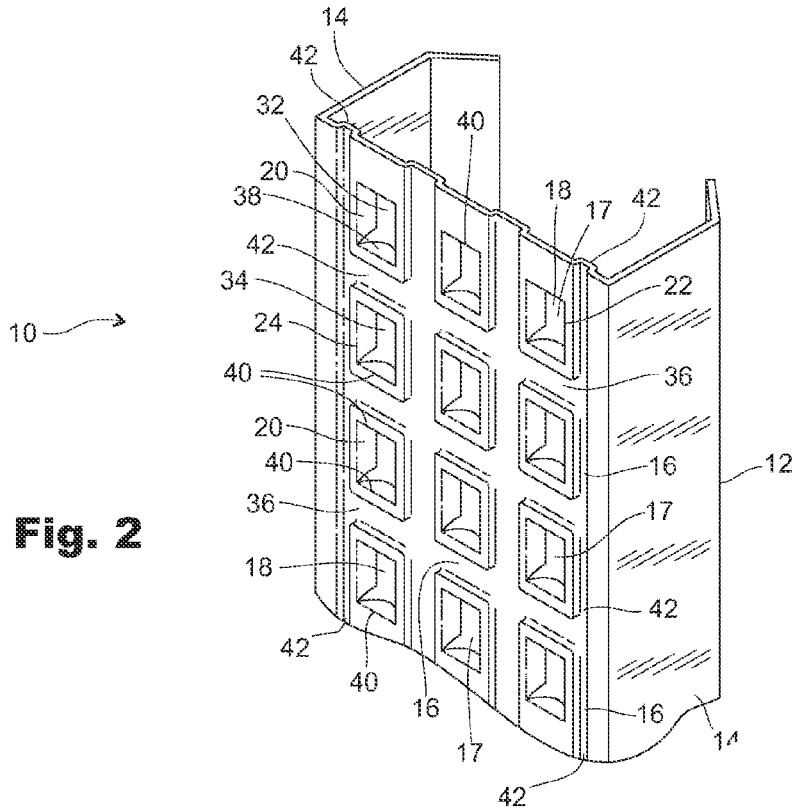
FIG. 2 is a perspective back view of the slotted stud of FIG. 1.
Figure 3:
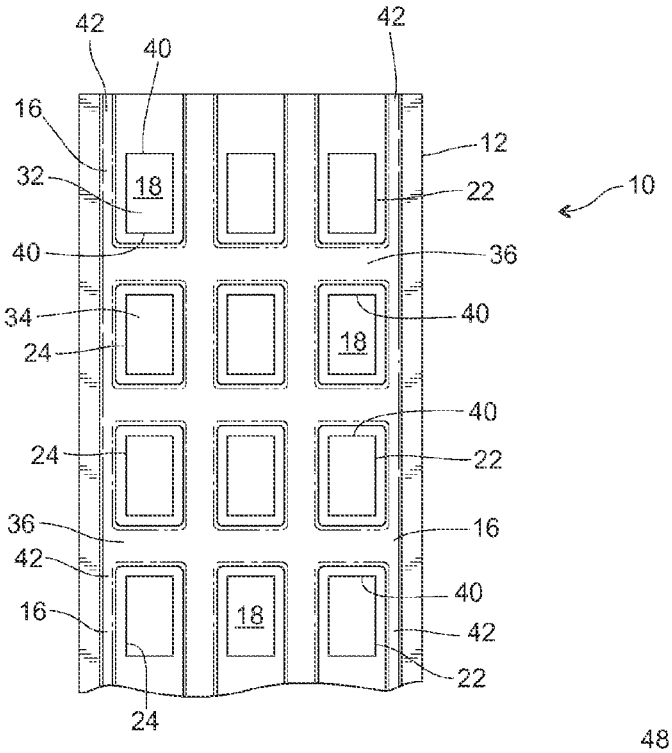
FIG. 3 is a front cut-away view of the slotted stud of FIG. 1 showing the web with the indentations.
Figure 4:
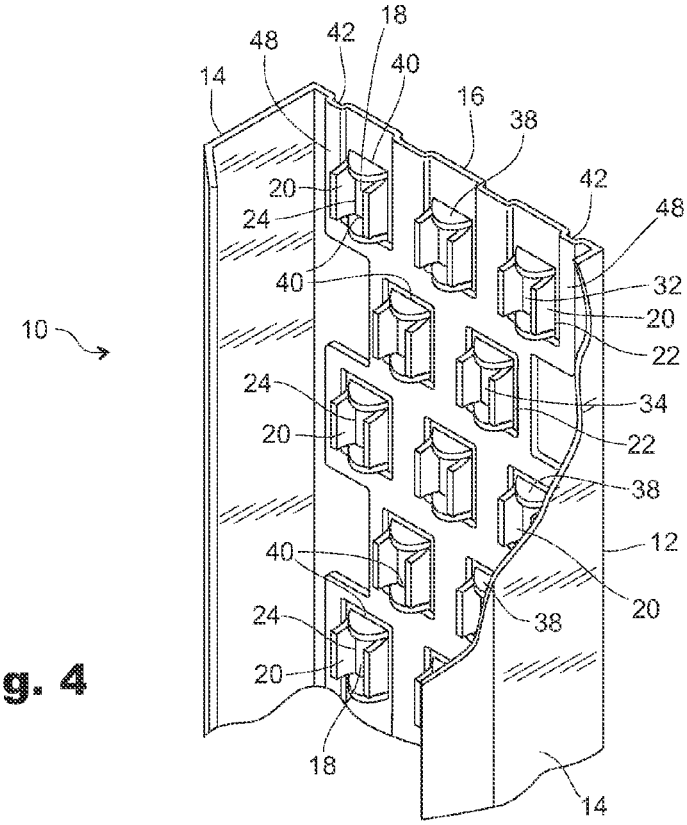
FIG. 4 is a perspective front view of the slotted stud with a plurality of side by side slots of a first set of slots alternating longitudinally with a plurality of side by slots of a second set of slots offset from slots of the first set of slots, showing indentations of a ladder shape about the slots.
Figure 4A:
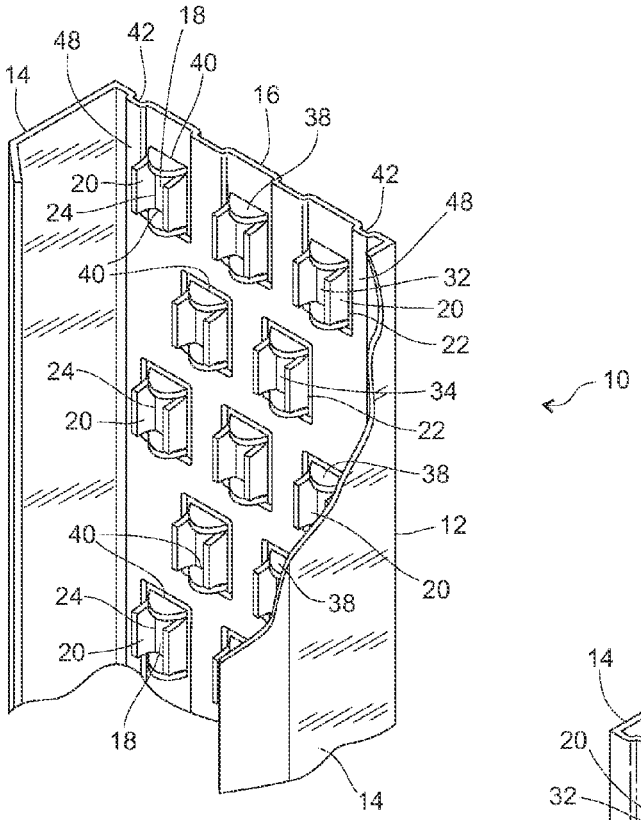
FIG. 4*a* is the slotted stud of FIG. 4 with the outer indent being straight as in FIGS. 1 through 3.
Figure 5:
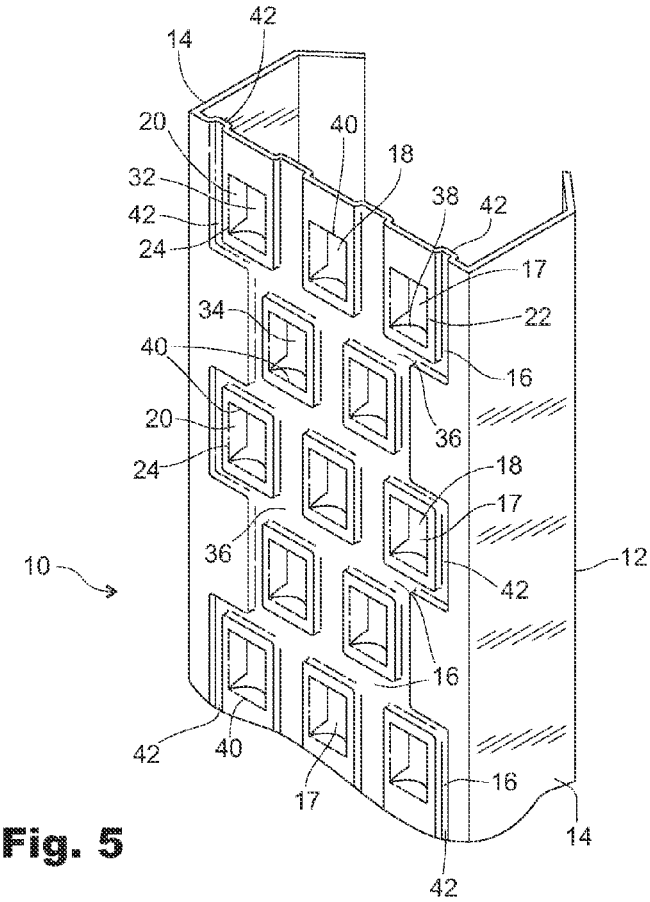
FIG. 5 is a perspective back view of the slotted stud of FIG. 4.
Figure 6:
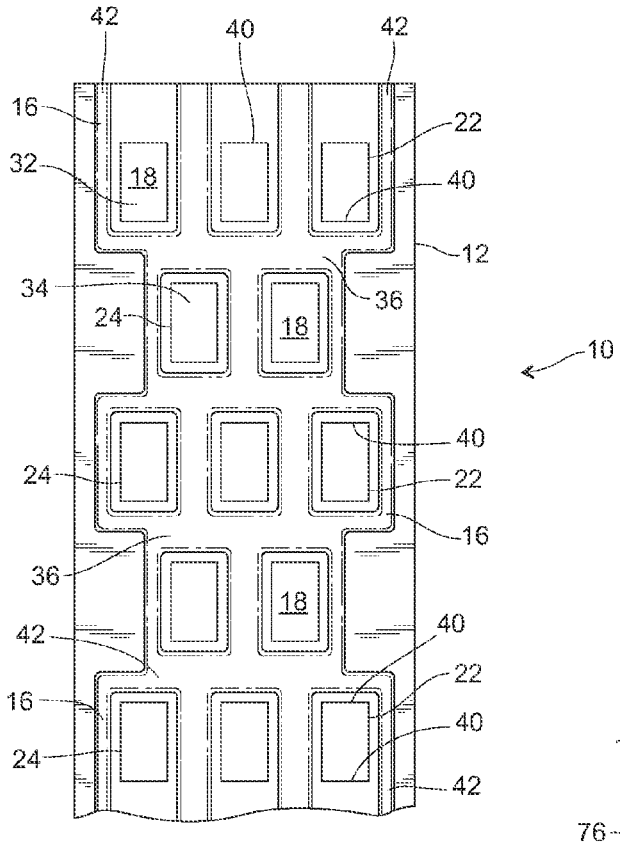
FIG. 6 is a front cut-away view of the slotted stud of FIG. 4 showing the web with the indentations.
Figure 7:
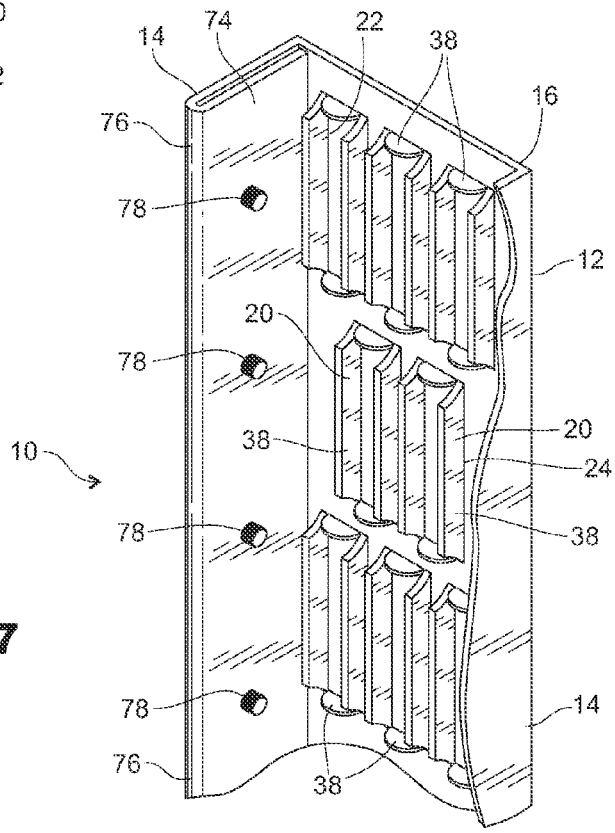
FIG. 7 is a perspective front view of the slotted stud of the present invention, showing a fold-back portion extending from the distal end of the primary flange back toward the web on each stud side.
Figure 8:
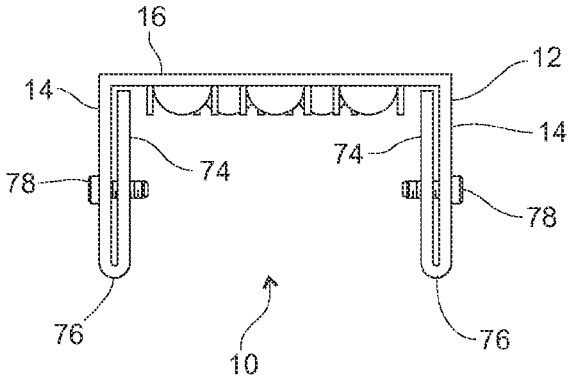
FIG. 8 is a perspective back view of the slotted stud of FIG. 7.
Figure 9:
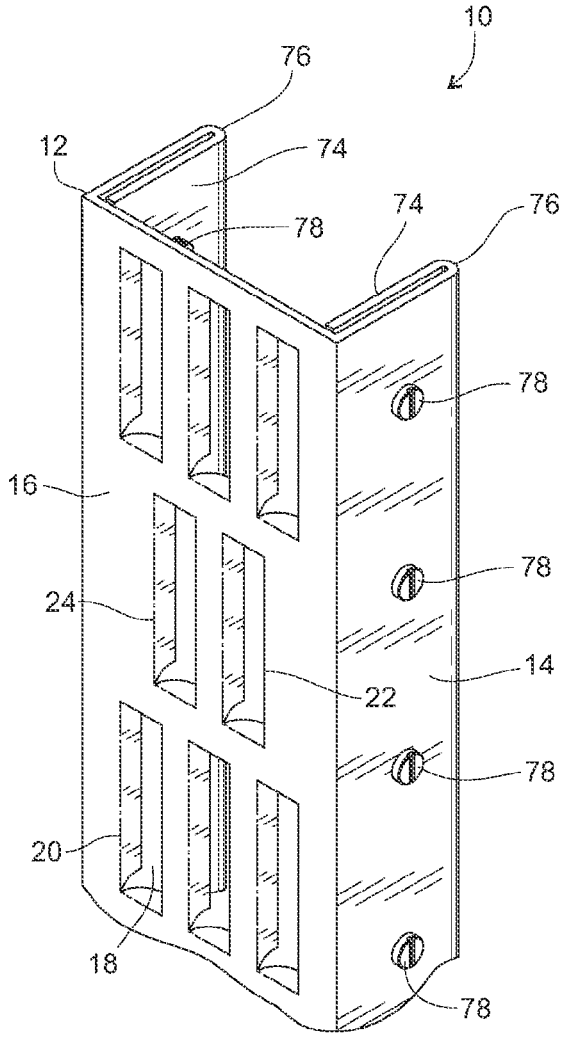
FIG. 9 is a front cut-away view of the slotted stud of FIG. 7 showing the web with the indentations.
Figure 10:
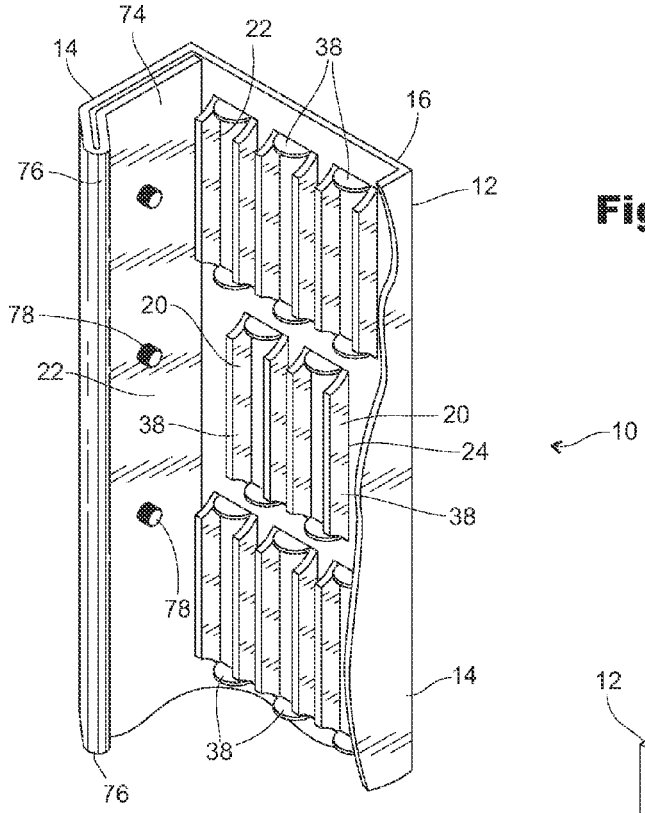
FIG. 10 is a perspective front view of the slotted stud of the present invention, showing a fold-back portion extending from the distal end of the primary flange back toward the web on each stud side with a lip extending inward at the distal end of the primary flange.
Figure 11:
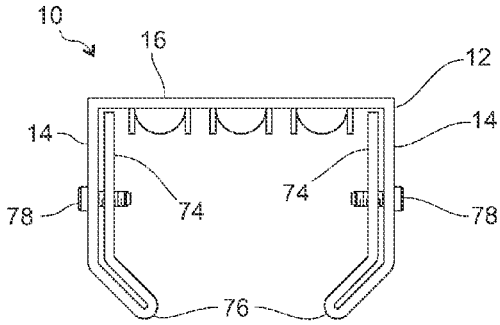
FIG. 11 is a perspective back view of the slotted stud of FIG. 10.
Figure 12:
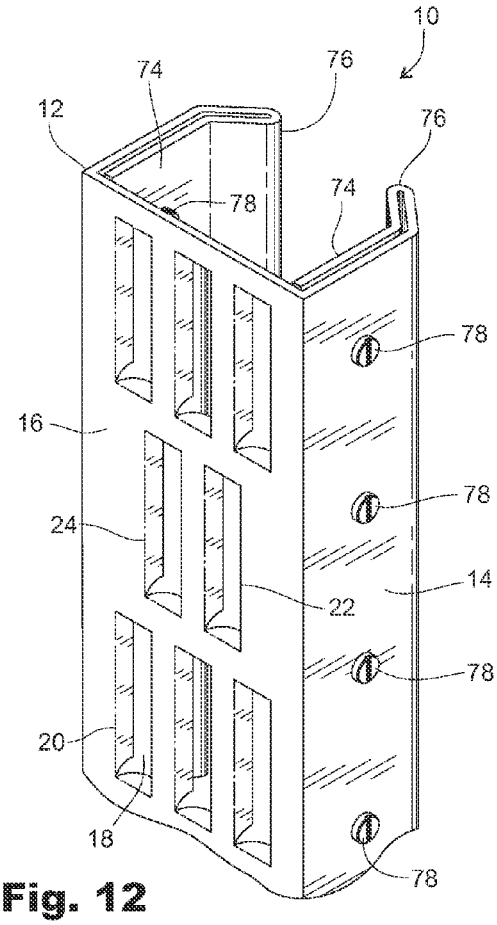
FIG. 12 is a front cut-away view of the slotted stud of FIG. 10 showing the web with the indentations.
Figure 10A:
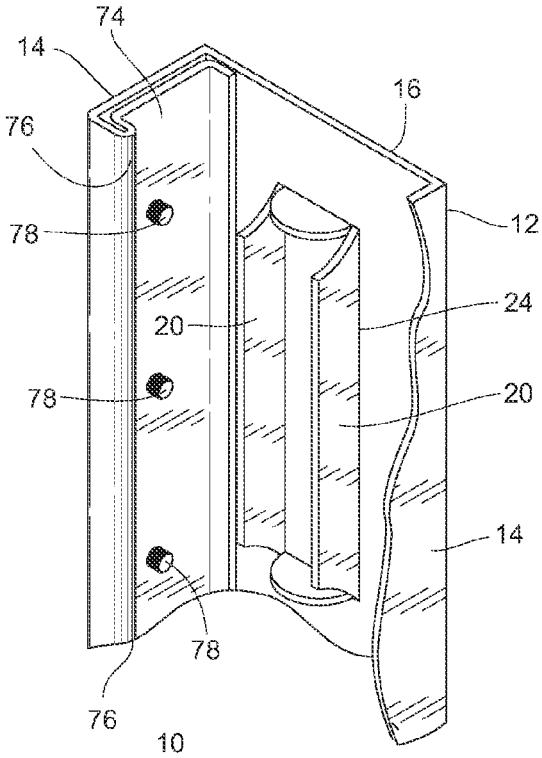
FIG. 10*a* is a perspective front view of the slotted stud of the present invention, showing a fold-back portion extending from the distal end of the primary flange back toward the web on each stud side.
Figure 11A:
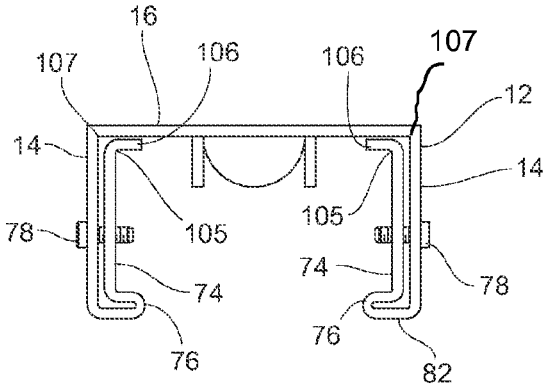
FIG. 11*a* is a cut view through the channel in FIG. 10*a*.
Figure 12A:
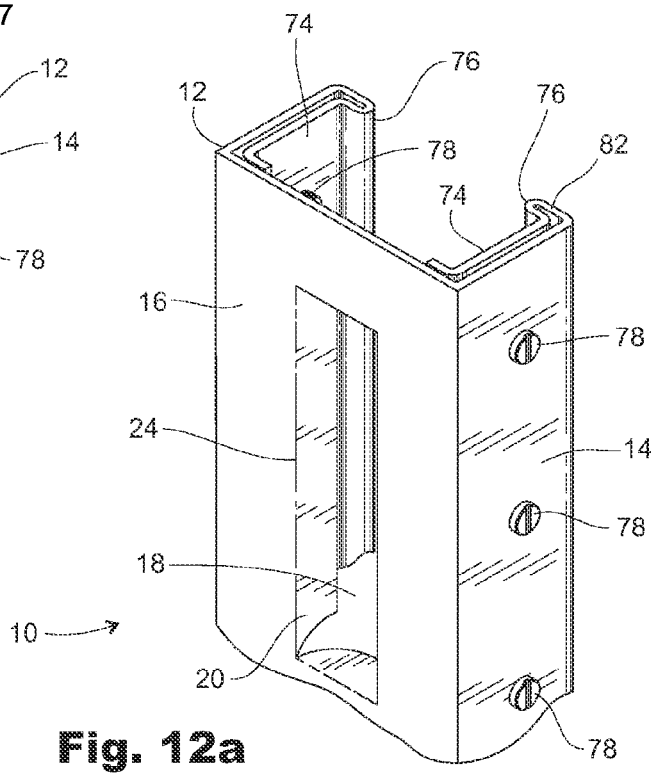
FIG. 12*a* is a perspective back view of the slotted stud FIG. 10*a*.
Figure 13:
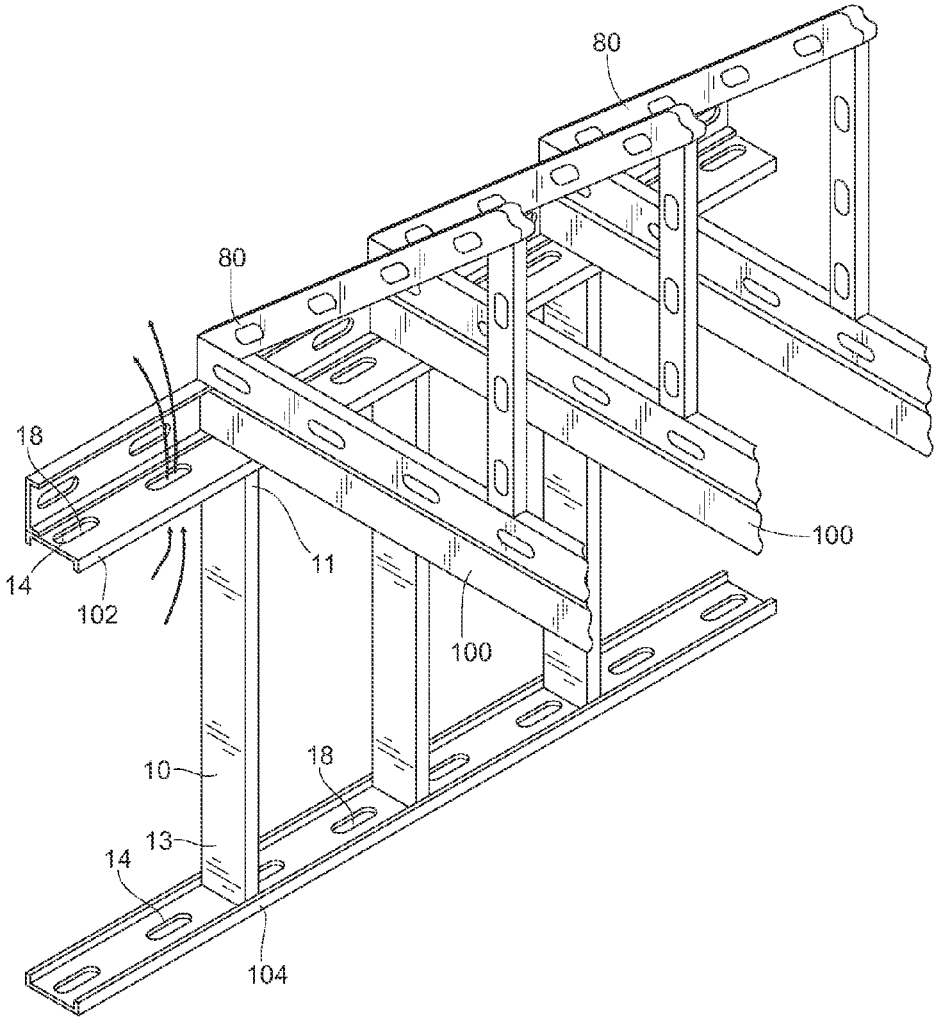
FIG. 13 is an isometric view of a building construction method.
Figure 14:
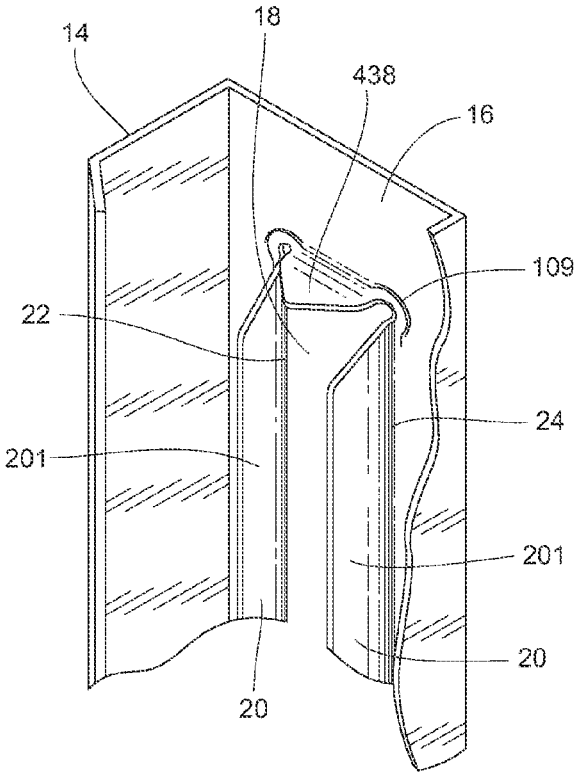
FIG. 14 is a perspective front view of an embodiment of the invention.
Figure 15:
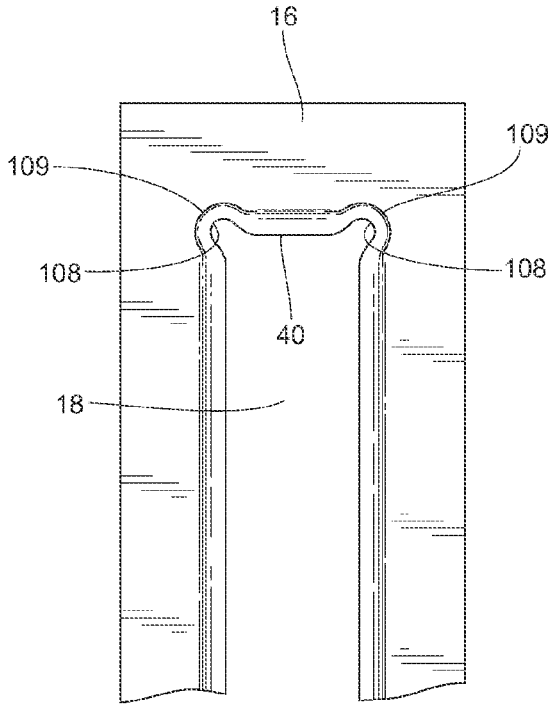
FIG. 15 is a back view of the embodiment of FIG. 14.

The slotted metal stud 10 of the present invention is intended for use in conventional construction of stud walls, such as a stud in a wall, as a building joist 100 and in forming a truss 80. In the conventional manner of wall and building construction, a plurality of studs are spaced apart vertically in parallel between horizontal floor joists and ceiling joists 100. Typically, a channel stud header 102 connected to the ceiling joists 100 and opening downward receives upper ends 11 of the studs 10. Similarly, a channel stud footer 104 connected to the floor joists 100 and opening upward receives lower stud ends 13. Because the joists 100 are required to support a lateral, or transverse load, they are larger and stronger than the studs 10, which support a compressive, or longitudinal load.

The stud 10, and similarly a joist 100 and truss 80, comprises a conventional C-shaped channel 12 including a pair of parallel primary flanges 14 bending from and extending in a same single direction from each side of a web forming the C-shaped channel 12, therein comprising a pair of parallel primary flanges 14 extending a same extent and separated by the web 16. (For all purposes herein, "side of a web" or such other similar term is deemed to mean a lateral edge of a web and "same single direction" means the primary flange 14 on each side of the web extends in a single direction from the web and is the same direction on both sides 22, 24 of the web, thus defining the "c" shape of a straight back, or web, and straight sides extending therefrom in a single and same direction, which could also be termed, "U-shaped." For these purposes, such a shape having a back with opposing sides extending therefrom will be termed "e-shaped.") In the preferred embodiment, the web 16 is unitary and a single piece wherein at least one and preferably a plurality of slots 18 are cut in the web 16 such that at least two supplemental flanges 20, and typically four including supplemental flanges 38 at slot ends, bend out of the slot 18 from first and second slot sides 22, 24 bounding the slot 18 to extend inward, between and parallel to the primary flanges 14. In this manner, the supplemental flanges 20 comprise a substantial areal portion and typically a third, of the web 16 bending from the web to form the slot. Preferably the supplemental flanges 20 respectively bend on vertical slot sides and extend substantially the vertical length of the slot. For these purposes, the vertical direction is longitudinal with the stud 10.

In the preferred embodiment, four separated supplemental flanges extend inward from the web 16 from four sides of a rectangular slot. Two supplemental flanges 20 extend from slot sides 22, 24 vertically, parallel with the primary flanges 14, and two supplementary flanges 38 extend horizontally, orthogonally to the primary flanges 14 from the slot ends 40 resulting in an opening 17 in the web 16 which opening forms the whole or substantially the whole of said slots 18. The transverse, or horizontal flange 38 may have a shape that is essentially an arcuate flange, including a semi-circular flange or semi-ellipsoidal flange, or quadrilateral, including trapezoidal.

In the preferred embodiment, a supplemental flange 20 extends from each side 22, 24 of a plurality of slots 18 all extending into the channel 12. With the supplemental flanges 20 formed out of the web 16 from web material removed and folded from the web 16 to form the slots 18, the amount of stud material remains unchanged from a traditional metal stud. Thus, the dimensions of the supplemental flanges 20 in the various configurations described above are defined by the dimensions of the slot from which it bends. That is, two supplemental flanges 20 extending from the two slot sides 22, 24 may each be half the width of the slot. If there are flanges extending from respective ends of a rectangular slot, the side supplemental flanges 20 are reduced by the shape of the top and bottom supplemental flanges 38. In maintaining the same amount of material in the stud, the stud does not reduce in support strength but in fact increases in support strength as calculated above.

Preferably, the supplemental flanges 20 are similar, symmetrically extending inward from the web 16 from said slot sides 22, 24, unconnected and spaced apart on opposite sides of the slot. Thus, each vertical supplemental flange 20 will be in width between its proximal end at the web 16 to its distal end a distance equal to half of the width of the slot 18. Though the supplemental flange preferably extends orthogonally from the web 16, it can also extend from the web 16 at any angle other than perpendicular to the web 16.

As the supplemental flanges 20 comprise a major portion, and even most of the web 16 bending inward between the primary flanges 14 forming the slot 18 and the supplemental flanges 20 the stud cross sectional center of gravity is moved away from the web 16 therein substantially transferring load support from the web 16 to the primary flanges 14. Thus, it is recognized that though the cross sectional center of gravity is away from the web 16 because of the contribution of the primary flanges 14 (and indentations, as described below) it is further moved away from the web 16 a distance from the web 16 greater than that of a C-shaped stud 10 without supplemental flanges 20 and a slotted web 16 when the supplemental flanges 20 are bent from the web 16 to their positions as supplemental flanges 20 between the primary flanges 14. It follows that for a stud 10 with a plurality of such slots 18 and supplemental flanges 20, each slot with at least two supplemental flanges 20 extending into the channel 12 formed by the primary flanges 14 and the web 16, the additional supplemental flanges 20 function to locate the center of gravity in the channel 12 even further away from the web 16.

For a stud with a relatively small web width, the slots 18 are preferably aligned vertically in the web 16 each thereby contributing to increase the distance of the center of gravity from the web 16 maintaining symmetry in the stud 10 for uniform load support through the stud 10. For a joist 100 or truss 80 or other beam of wider web width, sets of two or more slots 18 may be side by side in the web 16 with a plurality of sets of slots spaced apart along the joist, beam or truss member, longitudinally. The sets of slots may be aligned vertically or slots in a set of slots may be staggered from slots in an adjacent set of slots. For example, a set of slots may comprise three slots and an adjacent set of stud may comprise two slots with each of the three slots staggered from each of the two slots in the adjacent set of slots. This may continue through the length of the joist, beam or truss member with sets of three slots alternating with sets of two slots. Similar other configurations of sets of slots may alternate along the joist, beam or truss member with sets having a different number of slots.

In practice, at least a first and a second set of slots 32, 34 are disposed longitudinally adjacent in the web 16 forming a web bridge 36 between them that extends transversely on the web 16.

The stud 10 further comprises an indentation 42 opposite each end of the bridge 36 that extends longitudinally in the web 16 spaced apart from and at least partially alongside the slots 18. The indentation 42 includes a bridge portion 46 that extends into the bridge 36 between ends 40 of adjacent slots 18. Typically, the stud 10 comprises a plurality of slots 18 longitudinally in the stud 10 extending its entire or substantially its entire length with a said indentation bridge portion 46 between ends of respective adjacent slots 18. The indentation bridge portion 46 may extend through the bridge 36 between indentations 42 on each side of adjacent slots 18 or just partially into the bridge 36.

Representative of many alternate shapes of the indentation 42, all of which are deemed included by the description given herein of representative shapes, the indentation 42 may have a shape essentially forming a triangular indentation, a quadrilateral or other multi-sided indentation, a circular indentation, or an ellipsoidal indentation, Or similarly it may have a shape that forms a "H" shaped indentation wherein the indentation 42 includes vertical portions 48 extending respectively from alongside a first adjacent slot 32 to alongside a second adjacent slot 34 with a bridge portion 46 extending through the bridge 36 between respective vertical portions 48 thereon forming a "H" shape that overlaps adjacent slots 32, 34 with slots received into upper and lower portions of the "H" above and below the bridge portion 46, respectively. The indentation 42 typically has a depth approximately that of a thickness of said stud 10.

The indentation 42 typically includes a vertical indentation portion that extends longitudinally in the web 16 spaced apart from and at least partially alongside the adjacent first and second slots 32, 34 extending from a position intermediate the first slot 32 to a position intermediate the second slot 34 and including a bridge portion 46 that extends into the bridge 36 between ends of adjacent slots 18.

A fold-back portion 74 may be provided in the stud 10 that is folded back from at least one of the respective flanges 14, and typically both, forming a line of flexure 76 between the primary flange 14 and the fold-back portion 74 having a resiliency wherein a screw 78 threaded into the primary flange 14 and then further into the fold-back portion 74 therein slightly pushing the fold-back portion 74 before being threaded in the fold-back portion 74 therein flexing the fold-back portion 74 away from the primary flange 14 on the line of flexure 76 captures the screw 78 as the flexure binds the screw between the primary flange 14 and the fold-back portion 74 substantially preventing the screw 78 from inadvertently unscrewing from the stud 10. A flange lip 82 may be included in which case the flange lip 82 bends inward from the primary flange 14 from its distal end 77 and the flange fold-back portion folds back from the flange lip distal end 84 to within the channel and continues parallel to the flange lip 82 spaced apart therefrom and then parallel to and along the primary flange 14 creating a line of flexure 76 at the distal end 84 of the flange lip 82.

A ninety degree bend 105 may be provided in the stud 10 that is folded back from at least one of the respective fold-back portions 74, and typically both, and extends adjacent to the primary flange 14 and along the primary flange root 107 which, connects the web portion 16 to the primary flange 14. The ninety degree bend 105 extends parallel to, and nests in, the primary flange root 107. A supplemental web 106 extends from the ninety degree bend 105 and continues along the web 16. This ninety degree radius and supplemental web provide additional stiffness at the primary flange root 107 and resist the inward flexure of the primary flanges 14 during buckling.

In the preferred embodiment, triangular transverse flanges 438 extend from the web 16 horizontally, orthogonally to the primary flanges 14 from the slot ends 40 of slot 18. This triangular transverse flange 438 creates a trapezoidal supplemental flange 201 when cut from a continuous web 16. When supplemental flanges 20 are cut from a continuous web 16 there forms at the corner of the slot 18 a stress concentration from which cracks can propagate. The propagation rate of cracks is inversely proportional to the radius of the crack starter. To prevent or slow crack growth at the corners of the slot 18, a slot corner radius 108 is added to each of four corners of slot 18. To increase stiffness of the web 16 material at the slot corner radius 108 the material is corrugated to create a corner radius indentation 109.

The invention claimed is:

1. A building stud comprising a single primary flange bending from and extending in a same single direction from each side of a web forming a C-shaped channel, the improvement comprising the web with a plurality of slots, wherein at least one of the slots further comprises at least two supplemental flanges extending respectively from at least two sides of said slot, the at least two supplemental flanges together comprising a portion of the web separated and bent away from the web on said at least two sides of said slot with the portion of the web removed by bending the supplemental flanges out of the web resulting in an opening in the web which opening forms the whole or substantially the whole of said slot and wherein the at least two supplemental flanges comprise a first and a second supplemental flange extending from respective first and second vertical sides of said slot which vertical sides are longitudinal with the stud and parallel to primary flanges, and further comprising a flange portion extending inward from the primary flange at its distal end forming a fold-back portion folded back from at least one of the respective primary flanges forming a line of flexure between the primary flange and the foldback portion having a resiliency wherein a screw threaded into the primary flange and then further into the fold-back portion therein slightly pushing the fold-back portion before being threaded in the fold-back portion flexing the fold-back portion away from the primary flange on the line of flexure captures the screw as the flexure binds the screw between the primary flange and the fold-back portion substantially preventing the screw from inadvertently unscrewing from the stud, a primary flange root connecting the web portion to the primary flange, a single ninety degree bend is provided in at least one of the respective fold-back portions and extends parallel to the primary flange and continues parallel to the primary flange root and is adjacent thereto, a supplemental web extends from the ninety degree bend and continues along the web to provide additional stiffness at the primary flange root and resist the inward flexure of the primary flanges during buckling.

2. The building stud of claim 1 further comprising a flange lip bending inward from the primary flange wherein said flange fold-back portion folds back from the flange lip distal end to within the channel and continues parallel to the flange lip spaced apart therefrom and then parallel to and along the primary flange creating a line of flexure at the distal end of the flange lip.

3. The building stud of claim 1 further comprising a triangular transverse flange extending from the web horizontally and orthogonally to the primary flanges, a trapezoidal supplemental flange extending vertically, parallel to the primary flanges, a slot corner radius in at least one of the four corners of the slot to prevent stress concentration.

4. The building stud of claim 3 further comprising a corner radius indentation to increase the stiffness of the web material at the slot corner radius.

5. A building stud comprising a single primary flange bending from and extending in a same single direction from each side of a web forming a C-shaped channel, the improvement comprising the web with a plurality of slots, wherein at least one of the slots further comprises at least two supplemental flanges extending respectively from at least two sides of said slot, the at least two supplemental flanges together comprising a portion of the web separated and bent away from the web on said at least two sides of said slot with the portion of the web removed by bending the supplemental flanges out of the web resulting in an opening in the web which opening forms the whole or substantially the whole of said slot and wherein the at least two supplemental flanges comprise a first and a second supplemental flange extending from respective first and second vertical sides of said slot which vertical sides are longitudinal with the stud and parallel to primary flanges, and further comprising a flange portion extending inward from the primary flange at its distal end and a flange fold-back portion folds back from a flange lip distal end to within the channel forming a fold-back portion from at least one of the respective primary flanges forming a line of flexure between the primary flange and the fold-back portion having a resiliency wherein a screw threaded into the primary flange and then further into the fold-back portion therein slightly pushing the fold-back portion before being threaded in the fold-back portion flexing the fold-back portion away from the primary flange on the line of flexure captures the screw as the flexure binds the screw between the primary flange and the fold-back portion substantially preventing the screw from inadvertently unscrewing from the stud, a primary flange root connecting the web portion to the primary flange, a single ninety degree bend is provided in at least one of the respective fold-back portions and extends adjacent and parallel to the primary flange and continues parallel to the primary flange root and is adjacent thereto, a supplemental web extends from the ninety degree bend and continues along the web to provide additional stiffness at the primary flange root and resist the inward flexure of the primary flanges during buckling, a slot corner radius in at least one of the four corners of the slot to prevent stress concentration.

6. The building stud of claim 5 further comprising a corner radius indentation to increase the stiffness of the web material at the slot corner radius.

7. A building stud comprising a single primary flange bending from and extending in a same single direction from each side of a web forming a C-shaped channel, the improvement comprising the web with a plurality of slots, wherein the slots further comprises two supplemental flanges extending respectively from two sides of said slot, the two supplemental flanges together comprising a portion of the web separated and bent away from the web on said two sides of said slot with the portion of the web removed by bending the supplemental flanges out of the web resulting in an opening in the web which opening forms the whole of said slot and wherein the two supplemental flanges comprise a first and a second supplemental flange extending from respective first and second vertical sides of said slot which vertical sides are longitudinal with the stud and parallel to primary flanges, and further comprising a flange portion extending inward from the primary flange at its distal end forming a fold-back portion folded back from both of the respective primary flanges forming a line of flexure between the primary flange and the foldback portion having a resiliency wherein a screw threaded into the primary flange and then further into the fold-back portion therein slightly pushing the fold-back portion before being threaded in the fold-back portion flexing the fold-back portion away from the primary flange on the line of flexure captures the screw as the flexure binds the screw between the primary flange and the fold-back portion substantially preventing the screw from inadvertently unscrewing from the stud, a primary flange root connects the web portion to the primary flange, a single ninety degree bend is provided in the fold-back portions and extends parallel to the primary flange and continues parallel to the primary flange root, a supplemental web extends from the ninety degree bend along the web to provide additional stiffness at the primary flange root and resist the inward flexure of the primary flanges during buckling, a slot corner radius in at least one of the four corners of the slot to prevent stress concentration.

* * * * *